US009865966B2

(12) United States Patent
Matsuura et al.

(10) Patent No.: US 9,865,966 B2
(45) Date of Patent: Jan. 9, 2018

(54) CONNECTOR

(71) Applicant: Sumitomo Wiring Systems, Ltd., Yokkaichi, Mie (JP)

(72) Inventors: Junya Matsuura, Mie (JP); Toshikazu Sakurai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/427,253

(22) Filed: Feb. 8, 2017

(65) Prior Publication Data

US 2017/0256888 A1 Sep. 7, 2017

(30) Foreign Application Priority Data

Mar. 4, 2016 (JP) ..... 2016-041851

(51) Int. Cl.
*H01R 13/62* (2006.01)
*H01R 13/629* (2006.01)

(52) U.S. Cl.
CPC ..... *H01R 13/62922* (2013.01)

(58) Field of Classification Search
CPC ..... H01R 13/62905; H01R 13/62911; H01R 13/62916; H01R 13/62922
USPC ..... 439/347, 157
See application file for complete search history.

(56) References Cited

U.S. PATENT DOCUMENTS 5,681,175 A * 10/1997 Busse ..... H01R 13/62977 439/157
5,823,807 A * 10/1998 Yamasaki ..... H01R 13/62916 439/157
5,871,363 A * 2/1999 Kimura ..... H01R 13/62905 439/157
5,876,226 A * 3/1999 Tsukakoshi ..... H01R 13/62922 439/157
5,888,080 A * 3/1999 Maejima ..... H01R 13/62905 439/157
5,899,762 A * 5/1999 Ainceri ..... H01R 13/62905 439/157
5,902,141 A * 5/1999 Iwahori ..... H01R 13/62927 439/157
5,904,584 A * 5/1999 Flask ..... H01R 13/62927 439/157
5,921,791 A * 7/1999 Ono ..... H01R 13/62922 439/157
5,928,011 A * 7/1999 Flask ..... H01R 13/4362 439/157

(Continued)

FOREIGN PATENT DOCUMENTS

JP 2015-69836 4/2015

*Primary Examiner* — Ross Gushi
(74) *Attorney, Agent, or Firm* — Gerald E. Hespos; Michael J. Porco; Matthew T. Hespos

(57) ABSTRACT

A slide lever (30) provided on a fit-in side housing (F) includes cam functioning portions (31) configured to enter the receptacle (11) in the process of connecting the waiting side housing (M) and the fit-in side housing (F), and the cam functioning portions (31) are formed with cam grooves (32) to be engaged with cam followers (15) in the process of connecting the two housings (F, M). An operating portion (33) projects substantially parallel to a moving direction of the slide lever (30) from rear end parts of the cam functioning portions (31) in an entering direction into the receptacle (11) and is arranged forwardly of a front face (S) of the panel (P).

2 Claims, 7 Drawing Sheets

(56) References Cited

U.S. PATENT DOCUMENTS 5,928,013 A * 7/1999 Iwahori ..... H01R 13/193 439/157
5,928,014 A * 7/1999 Sawayanagi ..... H01R 13/62905 439/157
5,957,709 A * 9/1999 Heimueller ..... H01R 13/62927 439/157
5,984,701 A * 11/1999 Sawayanagi ..... H01R 13/62905 439/157
6,036,509 A * 3/2000 Maejima ..... H01R 13/62905 439/157
6,036,510 A * 3/2000 Ono ..... H01R 13/62922 439/152
6,056,565 A * 5/2000 Sawayanagi ..... H01R 13/62905 439/157
6,083,058 A * 7/2000 Fujiwara ..... H01R 13/4362 439/595
6,102,718 A * 8/2000 Kumakura ..... H01R 13/62905 439/157
6,113,407 A * 9/2000 Martin ..... H01R 13/521 439/205
6,142,826 A * 11/2000 Bourillon ..... H01R 13/4364 439/157
6,149,473 A * 11/2000 Lalange ..... H01R 13/4368 439/157
6,155,850 A * 12/2000 Martin ..... H01R 13/62911 439/157
6,155,855 A * 12/2000 Weil ..... H01R 13/62905 439/189
6,168,445 B1 * 1/2001 Seutschniker ... H01R 13/62933 439/157
6,183,279 B1 * 2/2001 Murakami ..... H01R 13/62905 439/157
6,193,530 B1 * 2/2001 Sakurai ..... H01R 13/62905 439/153
6,200,164 B1 * 3/2001 Martin ..... H01R 13/62911 439/595
6,210,184 B1 * 4/2001 Kodama ..... H01R 13/621 439/157
6,213,795 B1 * 4/2001 Drescher ..... H01R 13/62977 439/152
6,217,354 B1 * 4/2001 Fencl ..... H01R 13/62977 439/157
6,244,880 B1 * 6/2001 Fukase ..... H01R 13/62911 439/157
6,254,407 B1 * 7/2001 Burns ..... H01R 13/62905 439/157
6,305,957 B1 * 10/2001 Fink ..... H01R 13/62977 439/157
6,345,995 B1 * 2/2002 Bigotto ..... H01R 13/62977 439/157
6,361,356 B1 * 3/2002 Heberlein ..... H01R 13/62977 439/157
6,361,362 B1 * 3/2002 Kressmann ..... H01R 13/62905 439/157
6,382,991 B2 * 5/2002 Kumakura ..... H01R 13/62922 439/153
6,382,992 B1 * 5/2002 Bouchan ..... H01R 13/62911 439/157
6,422,882 B1 * 7/2002 May ..... H01R 13/62905 439/157
6,475,004 B2 * 11/2002 Shuey ..... H01R 13/62911 439/157
6,506,985 B2 * 1/2003 Konda ..... H01H 9/085 200/16 E
6,641,423 B1 * 11/2003 Giro ..... H01R 13/62977 439/157
6,652,298 B2 * 11/2003 Ohnuki ..... H01R 13/62977 439/157
6,663,291 B2 * 12/2003 Boemmel ..... H01R 13/62905 385/53
6,699,051 B2 * 3/2004 Hofmeister ..... H01R 13/62905 174/71 R
6,702,597 B2 * 3/2004 Pade ..... H01R 13/62933 439/157
6,824,406 B1 * 11/2004 Sharples ..... H01R 13/62977 439/157
7,207,848 B2 * 4/2007 Fukatsu ..... H01R 13/4362 439/157
7,347,704 B2 * 3/2008 Tsuji ..... H01R 13/62927 439/157
7,431,596 B2 * 10/2008 Fukatsu ..... H01R 13/62916 439/157
7,497,706 B2 * 3/2009 Daudin ..... H01R 13/514 439/157
7,520,764 B2 * 4/2009 Lee ..... H01R 13/62911 439/153
7,559,778 B2 * 7/2009 Pittenger ..... H01R 13/62955 439/157
7,568,923 B2 * 8/2009 Fukatsu ..... H01R 13/62916 439/154
7,618,271 B2 * 11/2009 Shiga ..... H01R 13/62922 439/157
7,695,296 B1 * 4/2010 Hitchcock ..... H01R 13/62922 439/157
7,695,297 B2 * 4/2010 Pittenger ..... H01R 13/62955 439/157
7,704,086 B2 * 4/2010 Gimbel ..... H01R 13/5202 439/157
7,891,996 B2 * 2/2011 Aoki ..... H01R 13/62922 439/157
8,197,270 B2 * 6/2012 Vasbinder ..... H01R 13/62922 439/157
8,215,987 B2 * 7/2012 Yoshioka ..... H01R 13/4362 439/587
8,235,742 B2 * 8/2012 Komiyama ..... H01R 13/62911 439/157
8,241,052 B2 * 8/2012 Mulot ..... H01R 13/639 439/299
8,297,993 B2 * 10/2012 Schmidt ..... H01R 13/62911 439/157
8,469,752 B2 * 6/2013 Park ..... H01R 13/506 439/752
8,992,240 B2 * 3/2015 Shiga ..... H01R 13/62 439/157
9,083,116 B2 * 7/2015 Oshita ..... H01R 13/62911
9,153,909 B2 * 10/2015 Takatsu ..... H01R 13/62905
9,276,352 B2 * 3/2016 Suzuki ..... H01R 13/56
9,287,662 B2 * 3/2016 Suzuki ..... H01R 13/62922
9,293,860 B1 * 3/2016 Kim ..... H01R 13/62927
9,325,112 B2 * 4/2016 Tabata ..... H01R 13/62905
9,666,984 B2 * 5/2017 Wanschoor ..... H01R 13/62922
2005/0106911 A1 * 5/2005 Sharples ..... H01R 13/62977 439/157
2008/0214039 A1 * 9/2008 Ciriello ..... H01R 13/62977 439/347
2011/0223793 A1 * 9/2011 Bischoff ..... H01R 13/4362 439/347
2012/0244737 A1 * 9/2012 Becavin ..... H01R 13/6395 439/347
2017/0125929 A1 * 5/2017 Fujii ..... H01R 13/62933

* cited by examiner

CONNECTOR

BACKGROUND

1. Field of the Invention

The invention relates to a connector.

2. Related Art

Japanese Unexamined Patent Publication No. 2015-069836 discloses a connector with a waiting side housing that penetrates through a mounting hole of a panel and a fit-in side housing to be fit into a receptacle of the waiting side housing. A slide lever is mounted on the fit-in side housing. The two housings are connected by fitting the fit-in side housing lightly into the receptacle at a front side of the panel and then sliding the slide lever in a direction intersecting a connecting direction of the two housings. The fit-in side housing is pulled into the receptacle by a cam action between cam followers of the receptacle and cam grooves of the slide lever.

The slide lever of the above-described connector is operated on a side forward of the panel, and the cam followers are provided on the outer surface of the receptacle. Thus, the entire slide lever, including an operating portion, is forward of the panel, and the receptacle needs to project a large distance toward the front of the panel. As a result, a large space is necessary at the front side of the panel where the fit-in side housing and the receptacle can be arranged side by side.

The invention was completed based on the above situation and aims to save space.

SUMMARY

The invention is directed to a connector with a waiting side housing to be mounted on a panel, and a receptacle is formed on the waiting side housing. The waiting side housing penetrates through a mounting hole of the panel and is open toward a front side of the panel. A cam follower is formed on an inner surface of the receptacle, and a fit-in side housing can be fit into the receptacle from the front side of the panel. A slide lever is provided on the fit-in side housing and is movable in a direction intersecting a connecting direction of the waiting side housing and the fit-in side housing. A cam functioning portion of the slide lever is configured to enter the receptacle in the process of connecting the waiting side housing and the fit-in side housing. A cam groove is formed in the cam functioning portion and is configured to engage the cam follower in the process of connecting the waiting side housing and the fit-in side housing. An operating portion projects substantially parallel to a moving direction of the slide lever from a rear end part of the cam functioning portion in an entering direction into the receptacle and is forward of the panel.

In connecting the waiting side housing and the fit-in side housing, the cam functioning portion of the slide lever is inserted into the receptacle, the cam groove is engaged with the cam follower and the operating portion is operated on a side forward of the panel to move the slide lever. Since the operating portion projects substantially parallel to the moving direction of the slide lever from the rear end part of the cam functioning portion in the entering direction into the receptacle, a front end part of the cam functioning portion in the entering direction into the receptacle can be arranged rearward of the panel. In this way, a projecting dimension of the receptacle toward the front of the panel can be small.

A pressing force from the slide lever could incline the cam follower improperly in the process of connecting the two housings. Accordingly, a flange may be formed on an outer periphery of the receptacle for locking to the panel, and the cam follower may be at a position corresponding to the flange in the connecting direction of the waiting side housing and the fit-in side housing. Thus, an area of the receptacle where the cam follower is formed is reinforced by the flange, and there is no possibility that the cam follower will incline improperly.

The cam follower is arranged at the position corresponding to the flange, and thus a front end part of the receptacle projects toward the front side of the panel. Accordingly, the receptacle may be formed with a cut for avoiding interference with the operating portion. The cut enables the operating portion to be accommodated partly in the receptacle by forming the receptacle. In this way, a dimension of the slide lever in the connecting direction of the two housings can be reduced as compared to the case where the receptacle is not formed with the cut.

DETAILED DESCRIPTION

Figure 5:
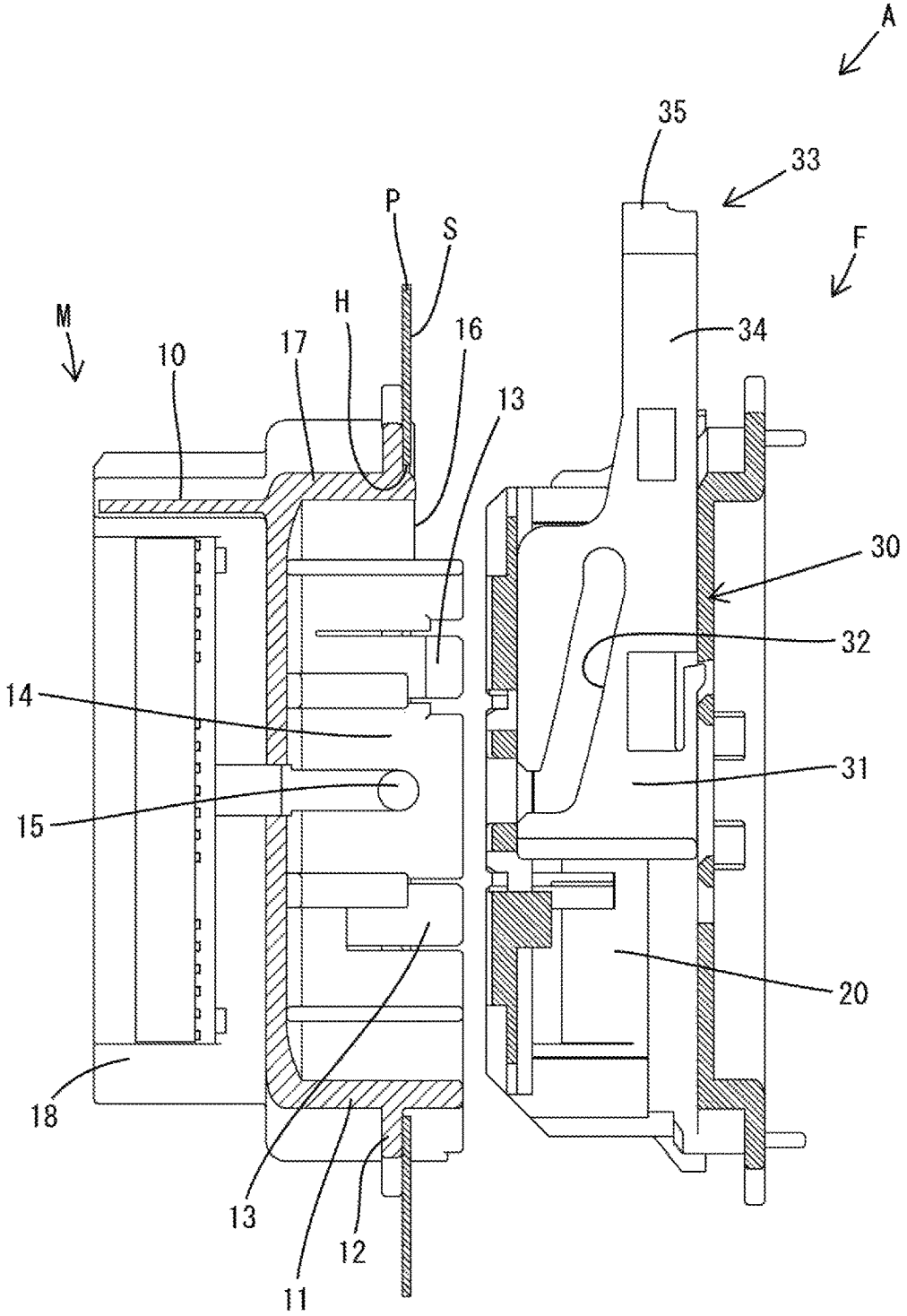
FIG. 5 is a side view partly in section showing a state before the waiting side housing mounted on a panel and the fit-in side housing are connected.
Figure 6:
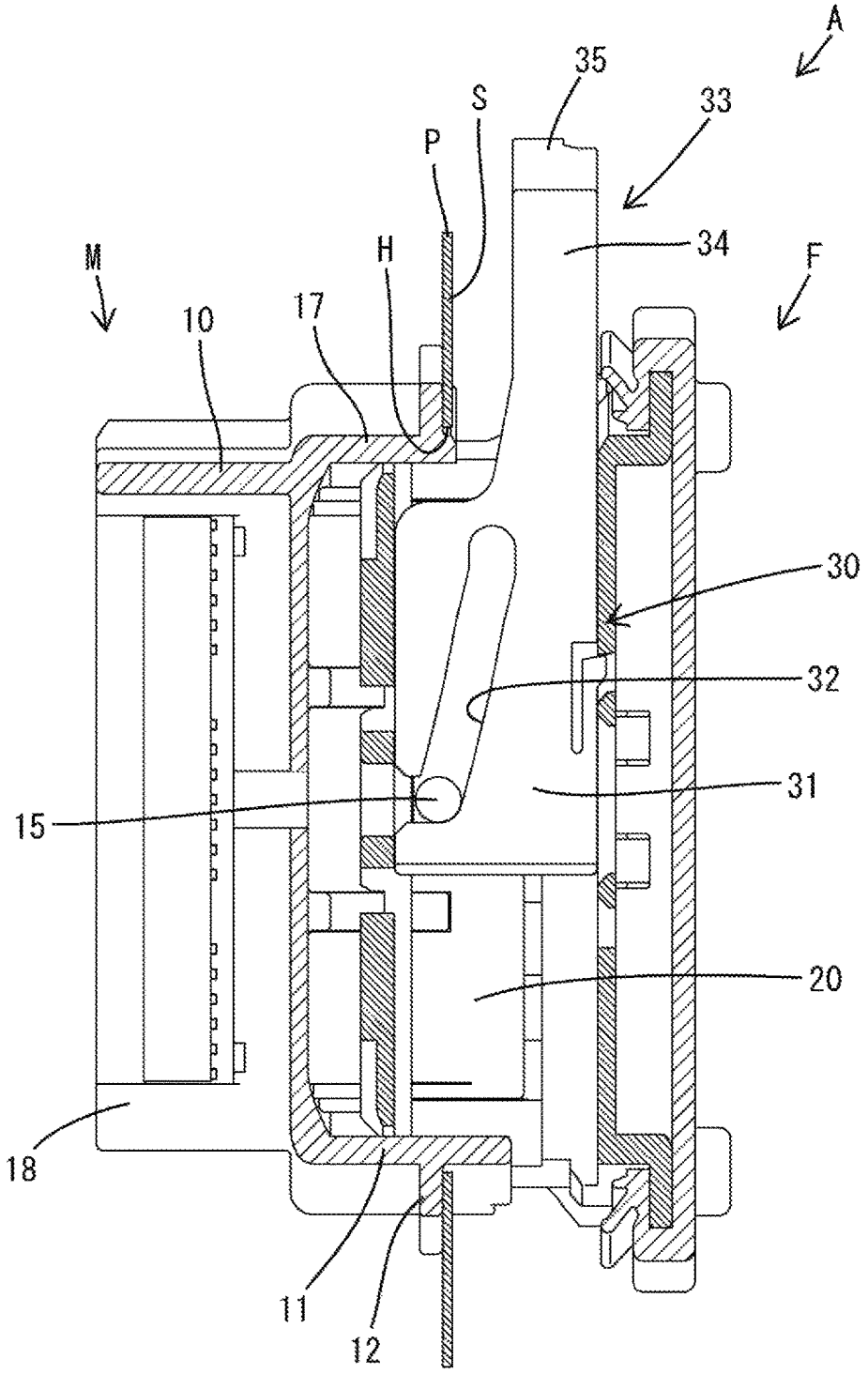
FIG. 6 is a side view partly in section showing a state where the fit-in side housing is lightly fitted in the waiting side housing and entrances of cam grooves are fitted to cam followers.
Figure 7:
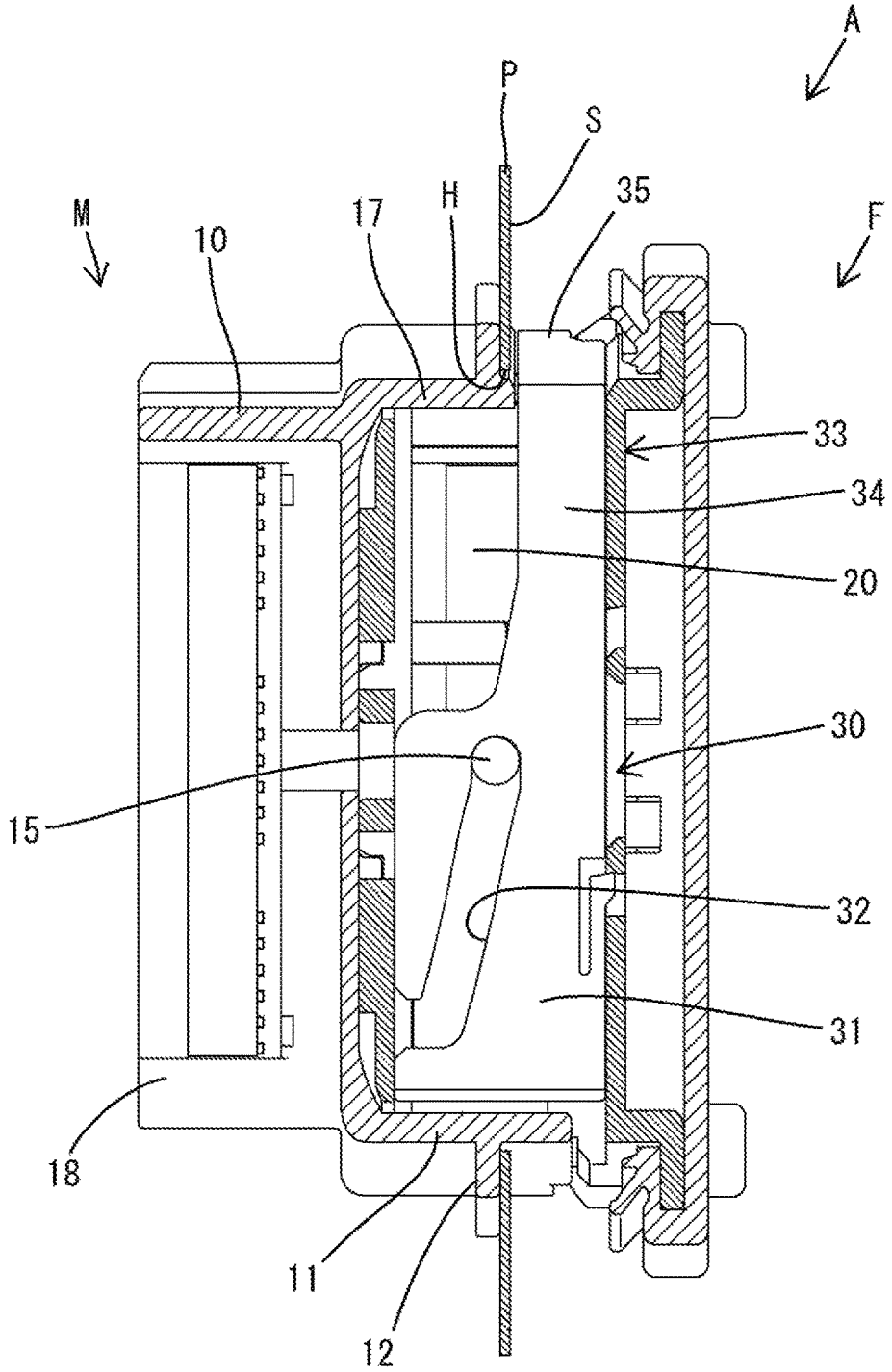
FIG. 7 is a side view partly in section showing a state where the waiting side housing and the fit-in side housing are properly connected.

One embodiment of the invention is described with reference to FIGS. 1 to 7. In the following description, a right side in FIGS. 5 to 7 is defined as a front concerning a front-rear direction. Upper and lower sides shown in FIGS. 1 to 7 are defined as upper and lower sides concerning a vertical direction.

A connector A of this embodiment is to be mounted on a panel P constituting a body of an automotive vehicle. The panel P is formed with a mounting hole H penetrating from a front face S to a back face thereof. The connector A includes a waiting side housing M to be held on the panel P in advance and a fit-in side housing F to be connected to this waiting side housing M from the side of the front face S of the panel P.

The waiting side housing M includes a frame 10 made of synthetic resin and formed with a receptacle 11 projecting forward and having a vertically long tubular shape. A sub-housing 18 made of synthetic resin is assembled with the frame 10 from behind. Male terminal fittings (not shown) are mounted into the sub-housing 18 and tabs on front end parts of the male terminal fittings are surrounded by the receptacle 11.

A flange 12 projects like a rib and is formed over the entire circumference on the outer periphery of a front end part of the receptacle 11 and resilient locking pieces 13 are formed on the front end part of the receptacle 11. The waiting side housing M is mounted on the panel P with the receptacle 11 penetrating through the mounting hole H. The waiting side housing M is held mounted on the panel P by holding the flange 12 in contact with the back face of the panel P and locking the resilient locking pieces 13 to the front face S of the panel P.

Two bilaterally symmetrical cam followers 15 project on the inner surfaces of left and right side walls 14 of the receptacle 11. Each cam follower 15 has a cylindrical shape whose axis line extends laterally in a direction orthogonally intersecting both a connecting direction of the two housings F, M and a moving direction of a slide lever 30 (to be described later). The cam followers 15 are at positions overlapping the flange 12 in the front-rear direction (direction parallel to the connecting direction of the two housings F, M). Parts of the flange 12 and the cam followers 15 project toward opposite inner and outer sides from side walls 14.

With the waiting side housing M mounted on the panel P, the front end part (area in front of the flange 12) of the receptacle 11 projects farther forward than the front face S of the panel P. Further, the front end part of the receptacle 11 is formed with a cut 16 that is open in the front end edge of the receptacle 11 to allow communication between the inside and outside of the receptacle 11. The cut 16 is formed by cutting an area of an upper wall 17 of the receptacle 11 forward of the front face S of the panel P (side of the front face S) and areas of upper end parts of both left and right side walls 14 forward of the front face S of the panel P.

The fit-in side housing F includes a housing body 20 and the slide lever 30 made of synthetic resin. The slide lever 30 is relatively movable in the vertical direction between an initial position (see FIGS. 2, 5 and 6) and a connection position (see FIG. 7) below the initial position with respect to the housing body 20. Female terminal fittings (not shown) are accommodated in the housing body 20. The housing body 20 is formed with left and right guide walls 21 for movably guiding the slide lever 30. Spaces between the left and right side surfaces of the housing body 20 and the guide walls 21 serve as guide spaces 22 for vertically movably guiding the slide lever 30.

Figure 1:
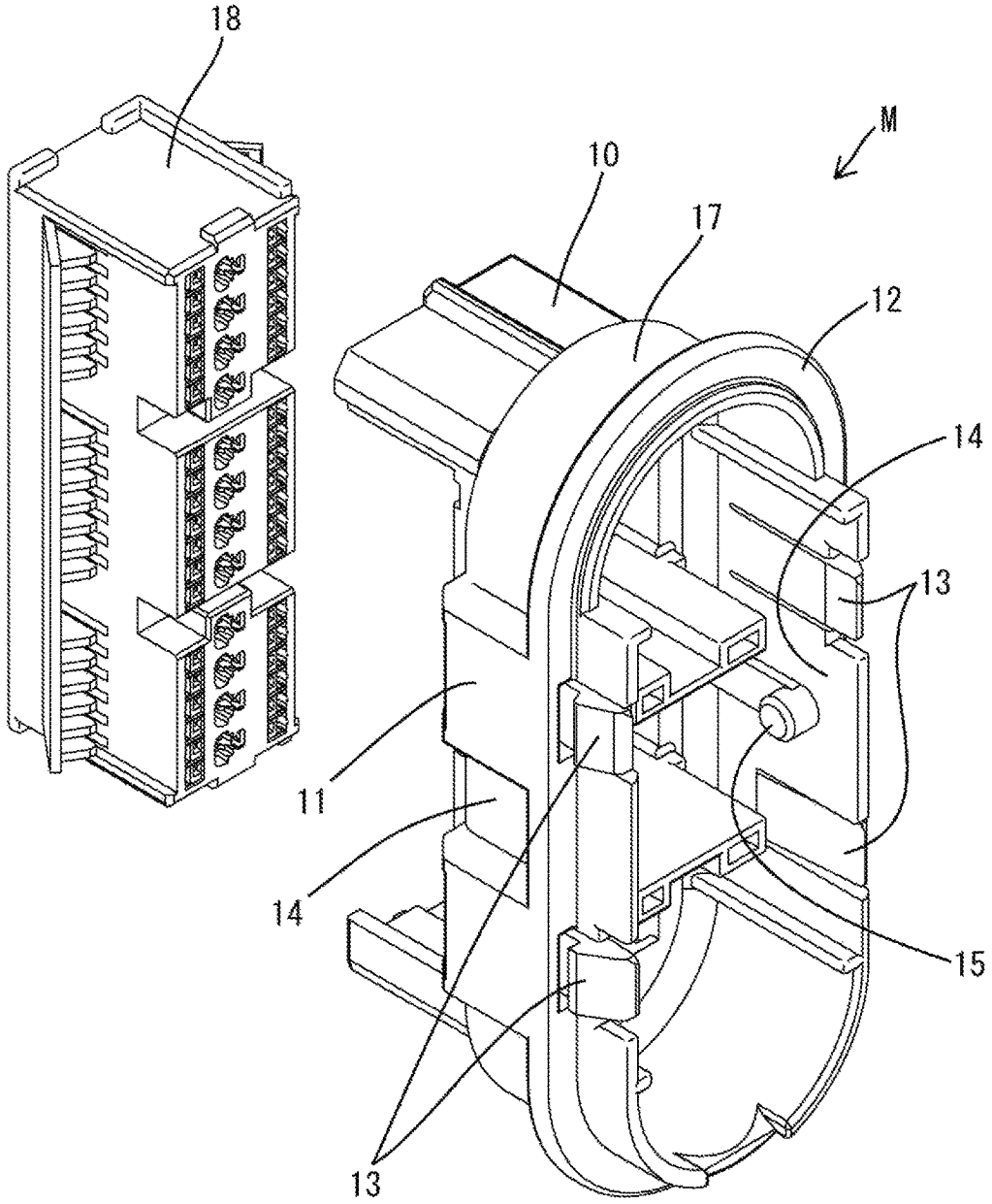
FIG. 1 is an exploded perspective view of a waiting side housing constituting a connector of one embodiment.
Figure 2:
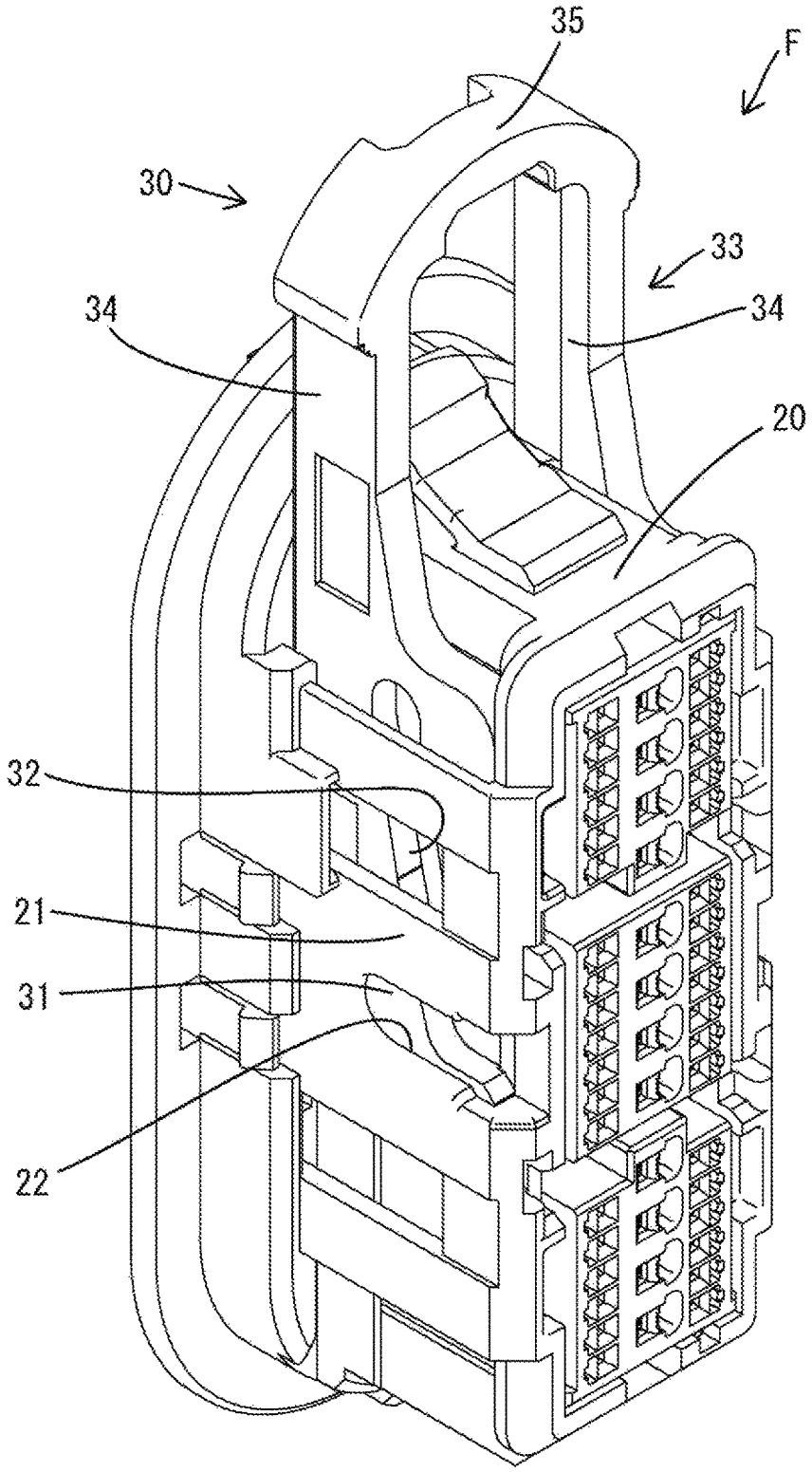
FIG. 2 is a perspective view of a fit-in side housing constituting the connector.
Figure 3:
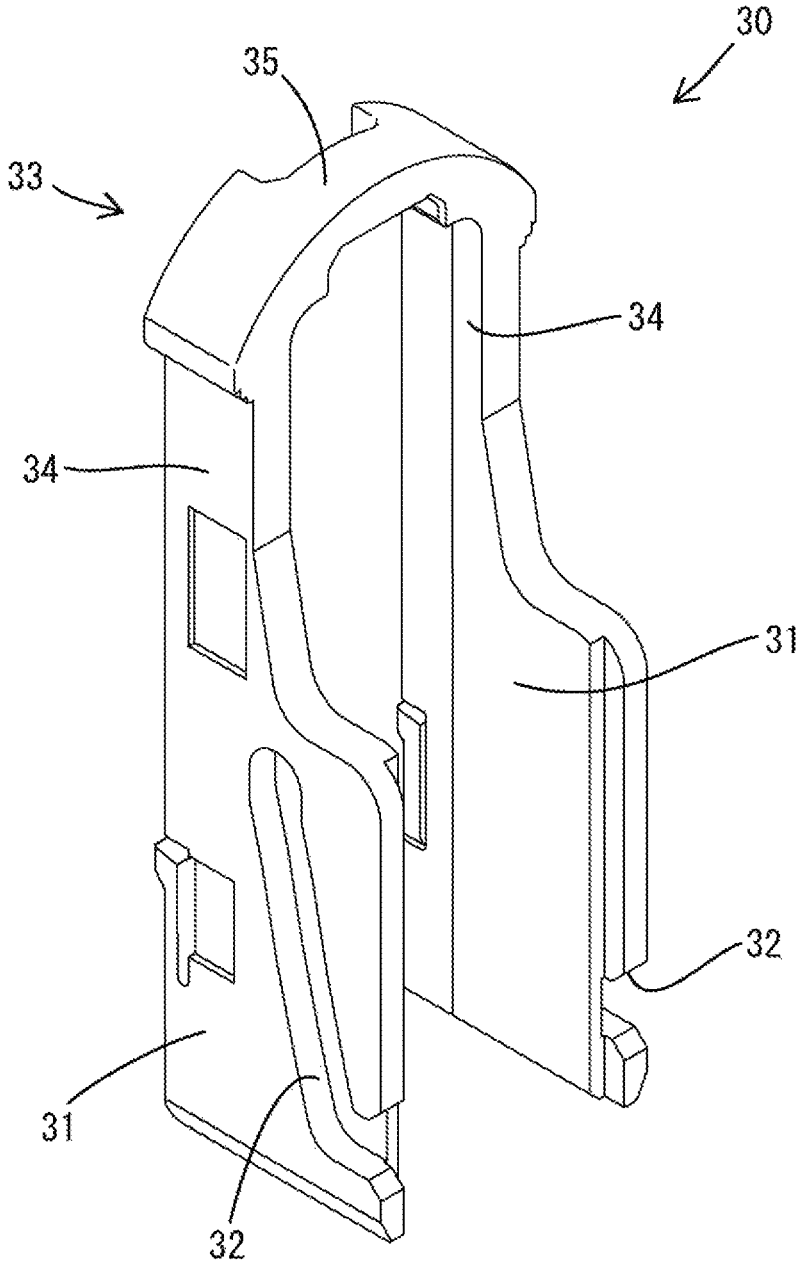
FIG. 3 is a perspective view of a slide lever.
Figure 4:
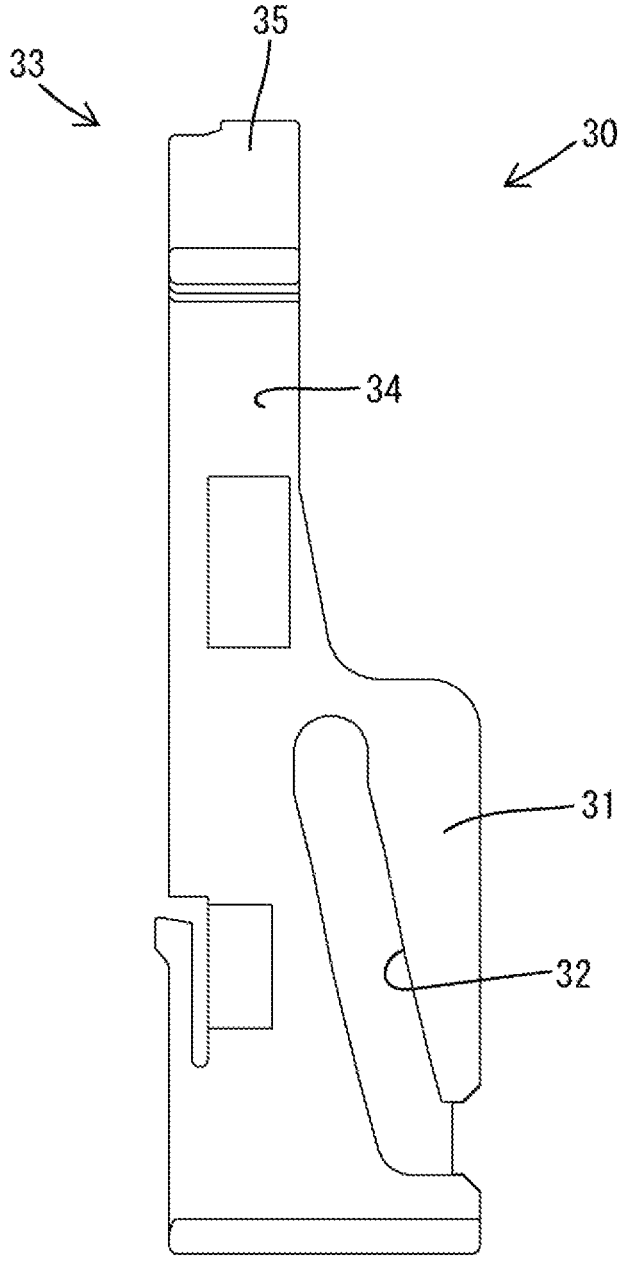
FIG. 4 is a side view of the slide lever.

The slide lever 30 is bilaterally symmetrical and includes left and right plate-like cam functioning portions 31 whose plate thickness directions extend in the lateral direction and an operating portion 33 coupling the upper ends of the cam functioning portions 31, as shown in FIG. 3. Each cam functioning portion 31 is formed with a cam groove 32 oblique to both the moving direction of the slide lever 30 and the connecting direction of the two housings F, M. The cam functioning portion 31 has a substantially rectangular shape in a side view.

At any position of the slide lever 30 from the initial position to the connection position, the cam functioning portions 31 are guided by the guide walls 21 while entirely extending along the outer side surfaces of the housing body 20. In the process of connecting the two housings F, M, the housing body 20 and parts of the cam functioning portions 31 are accommodated into the receptacle 11. Further, a vertical dimension of the cam functioning portions 31 is smaller than that of the housing body 20 (fit-in side housing F).

The operating portion 33 has left and right plate-like arms 34 whose plate thickness directions extend in the lateral direction similar to the cam functioning portions 31, and a coupling portion 35 coupling upper end parts of the left and right arms 34. Dimensions of the arms 34 and the coupling portion 35 in the front-rear direction (direction parallel to an entering direction of the fit-in side housing F into the receptacle 11) are smaller than that of the cam functioning portions 31 in the front-rear direction. Lower end parts of the arms 34 are continuous and flush with rear end parts of the upper end edges of the cam functioning portions 31 in the entering direction into the receptacle 11. The rear end edges of the arms 34 and the cam functioning portions 31 in the entering direction into the receptacle 11 are continuous and flush with each other. On the other hand, the front edges of the cam functioning portions 31 are located before (on the side of the receptacle 11) the front edges of the arms 34. The cam functioning portions 31 project more toward the receptacle 11 than the operating portion 33.

The operating portion 33 projects farther up than the cam functioning portions 31 and is displaced so that the arms 34 overlap with the outer side surfaces of the housing body 20 in the vertical direction as the slide lever 30 is moving from the initial position to the connection position. When the slide lever 30 reaches the connection position, the arms 34 substantially entirely overlap with the outer side surfaces of the housing body 20. Further, at the connection position, the coupling portion 35 overlaps with the upper surface of the housing body 20.

Next, the process of connecting the two housings F, M is described. The waiting side housing M is mounted into the mounting hole H of the panel P, and the fit-in side housing F with the slide lever 30 held at the initial position is inserted lightly into the receptacle 11 from the side of the front face S of the panel P. At this time, as shown in FIG. 5, a space in the front-rear direction for arranging the front end part of the receptacle 11 and the entire fit-in side housing F is necessary at the side of the front face S (front side) of the panel P. When the fit-in side housing F is inserted into the receptacle 11, the entrances of the cam grooves 32 are fit to the cam followers 15, as shown in FIG. 6. At this time, the fit-in side housing F and parts of the cam functioning portions 31 are more rearward than the back face (left surface in FIGS. 5 to 7) of the panel P.

From this state, the coupling portion 35 of the operating portion 33 is pushed from above to move the slide lever 30 down. As the slide lever 30 moves, the cam followers 15 and the cam grooves 32 are engaged to exhibit a cam action and the fit-in side housing F is pulled to the back of the receptacle 11. During this time, the cam functioning portions 31 are displaced down relative to the receptacle 11 while increasing a depth of insertion into the receptacle 11. During this time, the entire operating portion 33 is kept forward of the front face S of the panel P, but lower end parts of the arms 34 are accommodated into the receptacle 11 through the cut 16.

The two housings F, M reach a properly connected state when the slide lever 30 reaches the connection position, thereby completing the connection process, as shown in FIG. 7. In the properly connected state, a depth of insertion of the cam functioning portions 31 into the receptacle 11 is maximized, but the entire coupling portion 35 and most parts of the arms 34 are forward of the front face S of the panel P. Most parts of the cam functioning portions 31 and most parts of the cam grooves 32 are accommodated in the receptacle 11 and substantially half areas of the cam functioning portions 31 are located rearward of the back face of the panel P. Since most areas of the slide lever 30 are accommodated in the receptacle 11 in this way, most areas of the receptacle 11 can be arranged at the back side of the panel P.

As described above, the connector A of this embodiment includes the waiting side housing M to be mounted on the panel P and the fit-in side housing F to be fitted into the receptacle 11 of the waiting side housing M from the side of the front face S of the panel P. The waiting side housing M is formed with the receptacle 11 that penetrates through the mounting hole H of the panel P and is open toward the side forward of the front face S of the panel P, and the cam followers 15 are formed on the inner surface of the receptacle 11.

The fit-in side housing F is provided with the slide lever 30 that is movable in the vertical direction intersecting with the connecting direction of the two housings F, M. The cam functioning portions 31 of the slide lever 30 are inserted into the receptacle 11 in the process of connecting the two housings F, M. The cam functioning portions 31 are formed with the cam grooves 32 to be engaged with the cam followers 15 in the process of connecting the two housings F, M. The operating portion 33 of the slide lever 30 projects substantially parallel to the moving direction of the slide lever 30 from rear end parts of the cam functioning portions 31 in the entering direction into the receptacle 11. The operating portion 33 is arranged on the side forward of the front face S of the panel P in the process of connecting the two housings F, M.

In connecting the two housings F, M, the cam functioning portions 31 of the slide lever 30 are inserted into the receptacle 11, the cam grooves 32 are engaged with the cam followers 15 and the operating portion 33 is operated on the side forward of the front face S of the panel P. Thus, the slide lever 30 is moved from the initial position to the connection position. The operating portion 33 projects substantially parallel to the moving direction of the slide lever 30 from the rear end parts of the cam functioning portions 31 in the entering direction into the receptacle 11. Thus, front end parts of the cam functioning portions 31 in the entering direction into the receptacle 11 can be arranged rearward of the panel P. In this way, a projecting dimension of the receptacle 11 toward the side of the front face S of the panel P can be small.

Further, in the process of connecting the two housings F, M, the cam followers 15 receive pressing forces from the sides of the cam grooves 32 of the slide lever 30. Thus, the cam followers 15 may incline improperly in a direction substantially parallel to the connecting direction of the two housings F, M. However, the flange 12 locked to the panel P is formed on the outer periphery of the receptacle 11 and the cam followers 15 are arranged at the positions corresponding to the flange 12 in the connecting direction of the two housings F, M. Thus, the flange 12 reinforces areas of the receptacle 11 where the cam followers 15 are formed, and there is no possibility that the cam followers 15 will incline improperly.

Further, the cam followers 15 are at the positions corresponding to the flange 12, the front end part of the receptacle 11 projects forwardly of the front face S of the panel P. Thus, if the entire operating portion 33 is arranged forwardly of the front end of the receptacle 11 when the two housings F, M are connected, a dimension of the slide lever 30 in the front-rear direction becomes larger. However, the front end part of the receptacle 11 is formed with the cut 16 for avoiding interference with the operating portion 33 so that the operating portion 33 is accommodated partly into the receptacle 11. According to this configuration, a dimension of the slide lever 30 in the connecting direction of the two housings F, M can be reduced as compared to the case where the receptacle 11 is not formed with the cut 16.

The invention is not limited to the above described and illustrated embodiment. For example, the following embodiments also are included in the scope of the invention.

Although the cam followers are arranged at the positions corresponding to the flange in the connecting direction of the two housings in the above embodiment, the cam followers may be arranged at positions deviated forwardly or rearwardly from the flange.

Although the rear end of the operating portion is located rearward of the front end of the receptacle in the connected state of the two housings in the above embodiment, the rear end of the operating portion in the connected state of the two housings may be located at the same position as or before the front end of the receptacle.

Although the receptacle is formed with the cut for avoiding interference with the operating portion in the above embodiment, the receptacle may not be formed with the cut.

LIST OF REFERENCE SIGNS

A . . . connector
F . . . fit-in side housing
H . . . mounting hole
M . . . waiting side housing
P . . . panel
S . . . front face of panel
11 . . . receptacle
12 . . . flange
15 . . . cam follower
16 . . . cut
30 . . . slide lever
31 . . . cam functioning portion
32 . . . cam groove
33 . . . operating portion

What is claimed is:

1. A connector, comprising:

a waiting side housing to be mounted on a panel;

a receptacle formed on the waiting side housing and configured to penetrate through a mounting hole of the panel and open toward a front side of the panel, a flange formed on an outer periphery of the receptacle and configured to be locked to the panel;

a cam follower formed on an inner surface of the receptacle;

a fit-in side housing to be fit in the receptacle from the front side of the panel;

a slide lever mounted on the fit-in side housing and movable in a direction intersecting a connecting direction of the waiting side housing and the fit-in side housing;

a cam functioning portion formed on the slide lever and configured to enter the receptacle in the process of connecting the waiting side housing and the fit-in side housing;

a cam groove formed in the cam functioning portion and configured to be engaged with the cam follower in the process of connecting the waiting side housing and the fit-in side housing; and an operating portion projecting substantially parallel to a moving direction of the slide lever from a rear end part of the cam functioning portion in an entering direction into the receptacle (11) and arranged forward of the panel, wherein the cam follower is arranged at a position corresponding to the flange in the connecting direction of the waiting side housing and the fit-in side housing.

2. The connector of claim 1, wherein the receptacle is formed with a cut for avoiding interference with the operating portion.

* * * * *